United States Patent [19]

Gray

[11] 3,936,696

[45] Feb. 3, 1976

[54] DIMMING CIRCUIT WITH SATURATED SEMICONDUCTOR DEVICE

[75] Inventor: George Gray, Lambertville, N.J.

[73] Assignee: Lutron Electronics Co., Inc., Coopersburg, Pa.

[22] Filed: Aug. 27, 1973

[21] Appl. No.: 391,953

[52] U.S. Cl. ..... 315/210; 315/DIG. 4; 315/DIG. 5; 315/224; 315/276

[51] Int. Cl.[2] ..... H05B 37/02

[58] Field of Search..... 315/DIG. 5, DIG. 4, DIG. 2, 315/276, 246

[56] References Cited

UNITED STATES PATENTS

| | | | |
|---|---|---|---|
| 3,611,024 | 10/1971 | Nakatsu et al. | 315/DIG. 4 |
| 3,619,716 | 11/1971 | Spira | 315/DIG. 2 |
| 3,681,654 | 8/1972 | Quinn | 315/DIG. 4 |

*Primary Examiner*—John S. Heyman
*Assistant Examiner*—B. P. Davis
*Attorney, Agent, or Firm*—Ostrolenk, Faber, Gerb & Soffen

[57] ABSTRACT

A fluorescent lamp is operated by a-c pulses having a pulse length sufficiently short that the lamp acts like slightly positive impedances. A pulse modulator which produces the pulses has a power transistor biased to saturation. However, varying the base drive of the saturated transistor causes a generally linear change in tube current to permit tube dimming and control. A servo circuit provides feedback control of the base drive to automatically compensate for variable effects to maintain constant tube lighting. Tube dimming is obtained by adjusting the feedback circuits of the servo.

31 Claims, 3 Drawing Figures

DIMMING CIRCUIT WITH SATURATED SEMICONDUCTOR DEVICE

RELATED APPLICATIONS

This application is related to copending application Ser. No. 173,530, filed Aug. 20, 1971, in the name of Joel S. Spira and Joseph Licata, entitled HIGH-FREQUENCY FLUORESCENT TUBE LIGHTING CIRCUIT WITH ISOLATING TRANSFORMER, and assigned to the assignee of the present invention.

BACKGROUND OF THE INVENTION

This invention relates to control circuits for the control of gas discharge tubes, and more particularly relates to a novel electronic ballast circuit for gas discharge tubes, particularly a fluorescent tube, which eliminates the need for a large inductive impednace and which permits a wide dimming range for the fluorescent tube.

Ballast circuits for fluorescent tubes are well known, and generally require a large and expensive inductance to prevent excessive tube current since the tube has a negative resistance characteristic. It is also known that fluorescent tubes are difficult to dim over an even modest brightness range.

BRIEF SUMMARY OF THE INVENTION

The present invention provides a-c current pulses to the lamp which have a short duration as suggested, for example, in the above application Ser. No. 173,530 and, in particular, the pulses are so short that the lamp behaves like a positive impedance. The lamp will also perform with d-c pulses.

It was found that the lamp will then behave like a slightly positive resistance so that large current limiting impedances are not needed. However, for reasons which are not fully understood, the pulse modulator which supplies the pulses and which consists of a power transistor with base drive control causes the light output of the tube to change as a direct function of pulse modulator drive, even though the transistor is always in apparent saturation.

A novel servo system is then provided to stabilize tube light output against variations in line voltage, aging, and variations between different tubes and components. The novel servo circuit can have a relatively simple structure since it can be relatively slow. Thus, because of the short pulse energization of the tubes, the tubes appear to behave like mildly positive resistances, and the circuit is relatively stable. Also, since the tube current is proportional to light output, the servo can respond to a measure of the tube current. Thus, the tube current is measured and used to vary pulse modulator drive. Thus, as tube current (and light output) increases, base drive is decreased so that output is stabilized.

The circuit also becomes easily dimmed over a wide range of brightness. Moreover, it has been found possible to dim V.H.O. (very high output) fluorescent tubes which may have lengths up to 8 feet with the present invention which were heretofore inpossible to dim. The dimming function is conveniently obtained by controlling pulse modulator drive through the servo.

Other features which are novel in the electronic ballast of the invention include overvoltage protection of the power transistor by control of the base drive of the transistor when the voltage across the transistor exceeds a given value. Moreover, the novel circuit lends itself to a flasher function by switching the tube between a high light intensity output and a low light intensity output.

In a specific embodiment of the invention, and to decrease radio frequency interference, two parallel-connected fluorescent tubes, mounted parallel to one another, carry current in opposite directions. A current balancing transformer insures proper division of current between the two tubes.

DETAILED DESCRIPTION OF THE DRAWINGS

Figure 1:
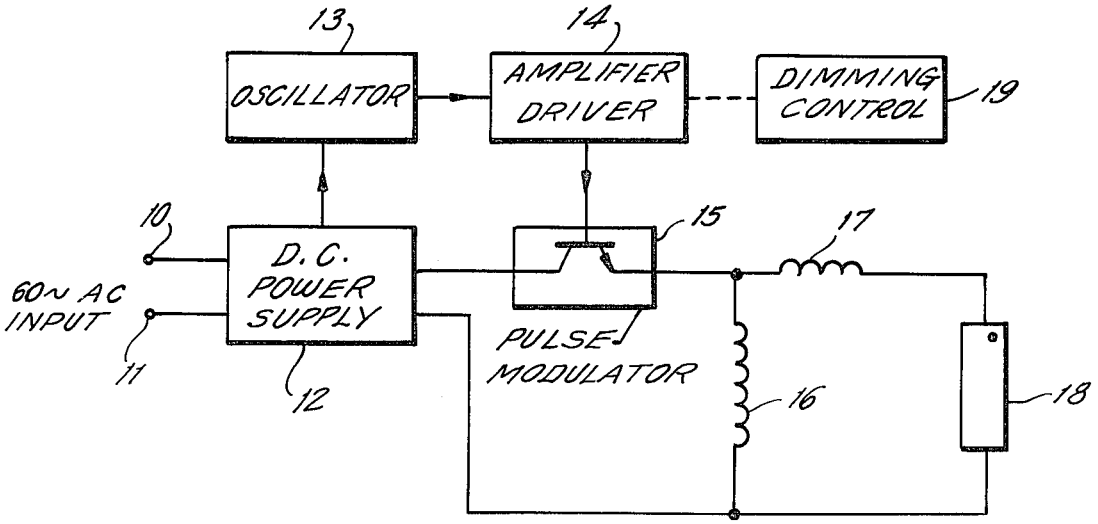
FIG. 1 is a block diagram of the circuit of the present invention for operating a tube in an a-c mode of operation.

Referring first to FIG. 1, there is illustrated the novel electronic ballast of the invention wherein a conventional 60 cycle a-c line input at terminals 10 and 11 is connected to operate a d-c power supply 12. The d-c power supply 12, in turn, drives an oscillator 13 which produces an output voltage, for example, of from about 20 kilohertz to 100 kilohertz, which output is connected to the amplifier driver 14 which produces a pulse output to the pulse modulator 15. Pulse modulator 15 consists of a power transistor having base drive supplied from the amplifier driver 14.

The pulse modulator 15 is then connected to a relatively small transformer consisting of inductively coupled windings 16 and 17 which are used to produce an a-c pulse output for the fluorescent lamp 18 from the input d-c pulse obtained from the pulse modulator 15. Note that coupled windings 16 and 17 are small in comparison to the conventional inductive ballast, normally used for fluorescent tubes (or other gas lamps discharge tubes) since the windings 16 and 17 limit current rise for only a very short time as compared to conventional 60 cycle operation.

In the embodiment of FIG. 1, it has been found that if the pulse current through modulator 15 has a duration of less than about 30 microseconds, the tube will not tend to conduct run-away current, which previously necessitated a heavy inductive ballast for prior art fluorescent lamps. In one particular embodiment of the invention, the oscillator 13 has a frequency of about 20 kilohertz with the amplifier driver 14 turning the pulse modulator on for about 20 microseconds in each cycle. The pulse length can be shorter than 20 microseconds but, as a practical matter, the switching losses of presently economically feasible transistors being to increase substantially.

When using pulse lengths of about 30 microseconds or less, the tube 18 of FIG. 1 is found to act like a slightly positive impedance. Consequently, the inductor 17 can be made to be either extremely small or removed altogether so that only a shunt inductor 16 remains.

In FIG. 1, the amplifier driver 14 is so adjusted that whenever it delivers an output to the pulse modulator 15, the base drive current causes the transistor of the pulse modulator 15 to saturate. Nevertheless, it has been found that increasing base drive even to the saturated transistor causes a change in the output of tube 18, such that base drive is proportional to the tube light output and thus the tube current. The reasons for this operation are not fully understood but have been verified for many different types of commercially available transistors in the pulse modulator 15.

Figure 2:
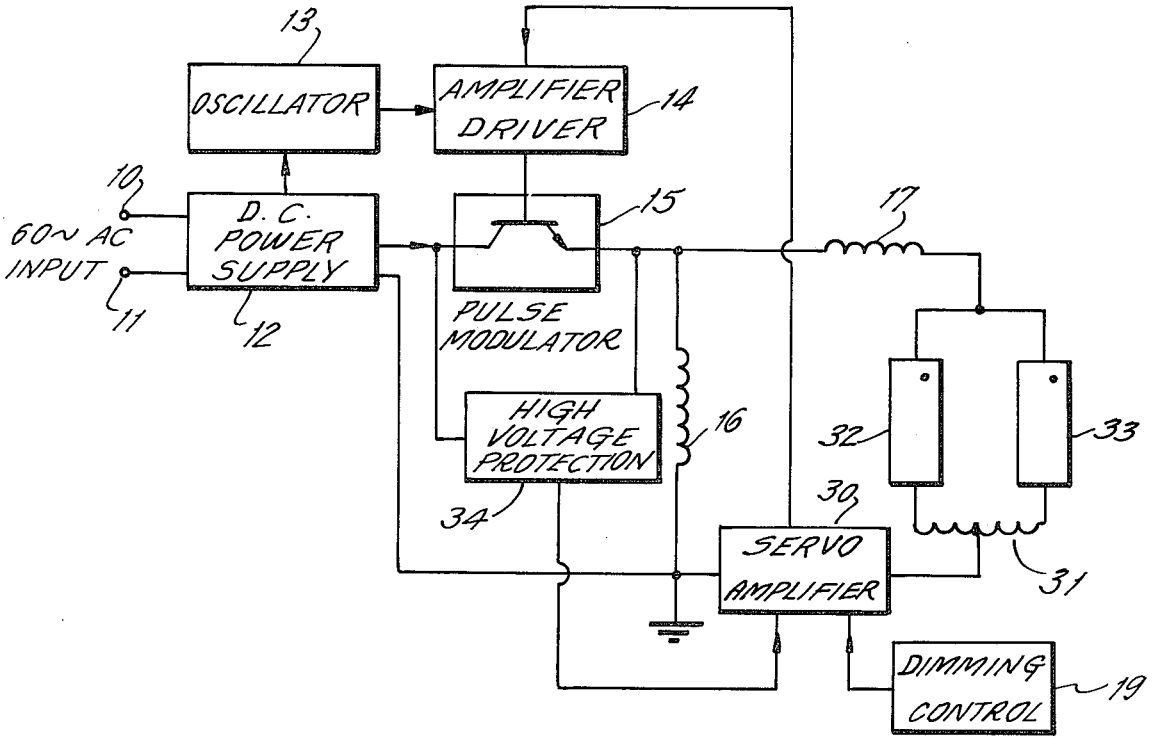
FIG. 2 is similar to the block diagram of FIG. 1, but shows the further provision of a servo system and high voltage protection circuit and dimming control through the servo system amplifier.

FIG. 2 shows the circuit of FIG. 1 with further components where circuits similar to those of FIG. 1 have been given similar identifying numerals. In FIG. 2 servo amplifier 30 is connected to the center tapped output of a current balancing transformer 31 which, in turn, balances the current between parallel-connected fluoresent tubes 32 and 33. Note that the tap could be arranged to intentionally unbalance the parallel currents, if desired, as for controlling the brightness of one tube relative to another. In particular, tubes 32 and 33 may be 96 inch tubes (as may be the tube 18 of FIG. 1). In the case of FIG. 2, the currents through the tubes 32 and 33 are balanced by the well known action of the current balancing transformer 31. However, as will be later seen and in order to reduce radio frequency interference, tubes 32 and 33 may be physically positioned so that current flow through them is in opposite directions.

In the circuit of FIG. 1, the dimmer control 19 caused dimming of the light in lamp 18 by modifying the base drive to the saturated pulse modulator 15. In FIG. 2 the dimming control circuit 19 operates through the servo amplifier 30 as will be later described.

The circuit of FIG. 2 further adds a novel high voltage protection circuit 34 which protects the pulse modulator 15 against damage during start up when the voltage across the transistor may be excessively high. The servo amplifier 30 of FIG. 2 is uniquely adapted to operate in the electronic ballast circuit because of the combined use of a short pulse length for actuating the fluorescent lamps and the proportional action between the base drive of the saturated transistor and the tube output and output light. These features permit the use of a relatively slow servo amplifier, thus simplifying the circuit configuration of the servo amplifier 30.

The servo amplifier 30 will operate such that when the tube current increases, the servo amplifier will produce a decrease in the output drive signal from amplifier driver 14, thereby causing the tube current to tend to decrease toward a balanced value and vice versa. In this way, the circuit can be operated at a fixed tube current regardless of variations in line voltage or component characteristics.

The dimming control circuit 19 may then operate through the servo amplifier 30, for example, by varying the reference voltage source within the servo amplifier 30.

The high voltage protection circuit 34 is also connected to the servo amplifier 30 and operates such that when the voltage across pulse modulator 15 exceeds some given value, it will cause the servo amplifier 30 to decrease the base drive, thereby to decrease the voltage across the pulse modulator 15.

Figure 3:
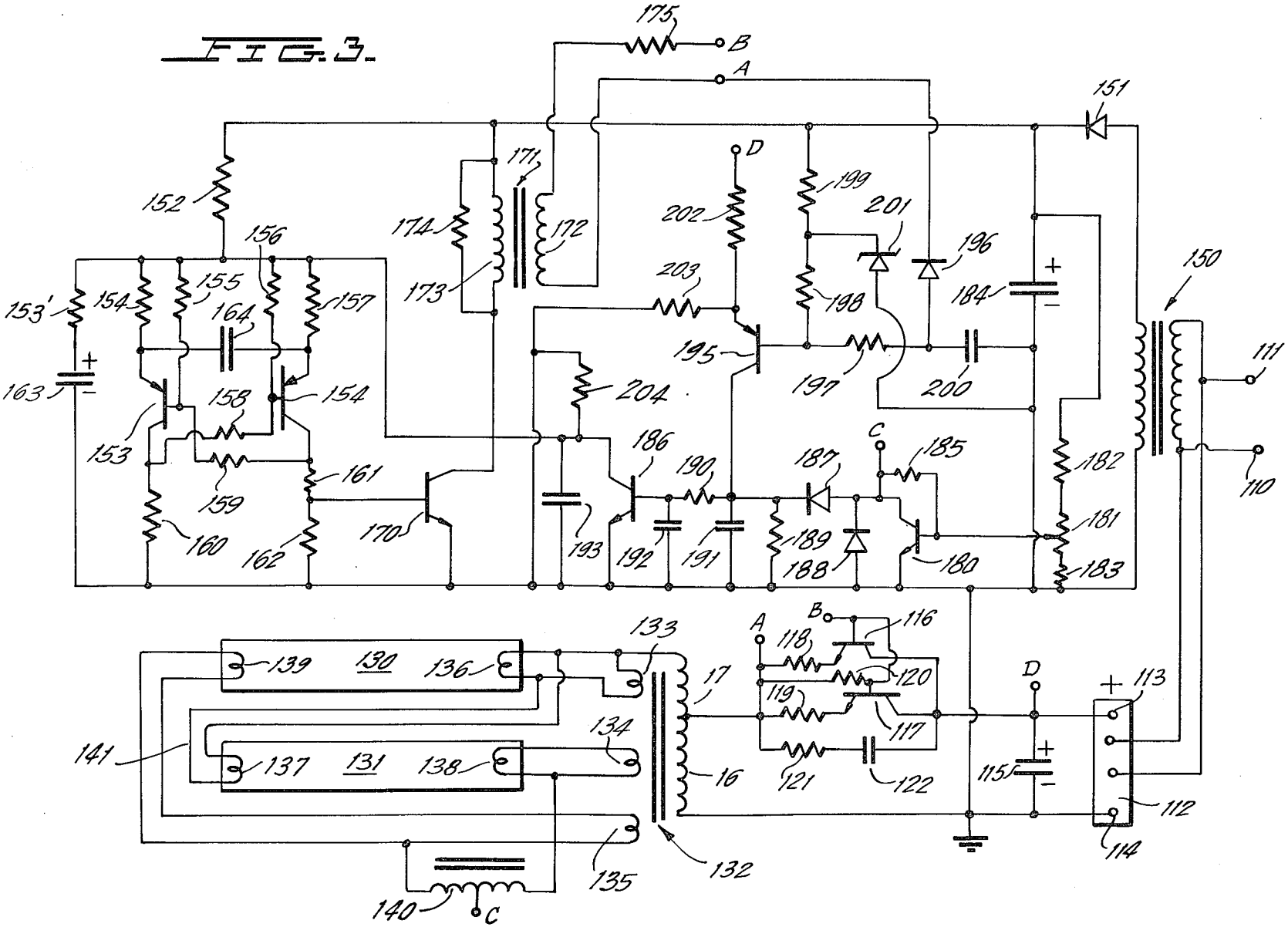
FIG. 3 is a detailed circuit diagram of one particular circuit which follows the concepts of FIG. 2 for the operation and dimming of two parallel-connected fluorescent lamps.

FIG. 3 shows a detailed circuit diagram which embodies features shown above in connection with FIG. 2. Referring now to FIG. 3, the input a-c power for operating the circuit is connected to terminals 110 and 111. Terminals 110 and 111 are then connected to rectifier 112 (schematically illustrated) which could, for example, consist of a full wave, bridge-connected rectifier system which has a d-c output terminal 113 and a negative output terminal 114. The rectifier 112 thus corresponds to the d-c power supply 12 of FIGS. 1 and 2.

The d-c output at terminals 113 and 114 is connected across a storage capacitor 115 and then in series with parallel-connected power transistors 116 and 117 which serve the function of the power transistor in the pulse modulator 15 of FIG. 2. Two parallel-connected transistors were provided because of the relatively high current which was to be conducted in the example of FIG. 3. Clearly, one or more such transistors could be used as required. One transistor type which can be used for the transistors 116 and 117 is the Texas Instruments transistor type TIP54. Similar transistors of other manufacturers have been tested and the same unusual result of increasing tube current as a function of base drive of a saturated transistor were obtained.

The emitters of each of transistors 116 and 117 are connected to terminal A through resistors 118 and 119. The base leads of transistors 116 and 117 are connected to one another and to the base terminal B, with a resistor 120 connecting the base leads to terminal A. A resistance-capacitance circuit component resistor 121 and capacitor 122 are connected in parallel with the emitter-collector circuits of each of transistor circuits 116 and 117. It will be noted that the terminals A and B are the input control terminals which receive the base drive for driving the pulse modulator formed of transistors 116 and 117, as will be later described.

Terminal A is then connected to the center tap between transformer winding sections 16 and 17 corresponding to windings 16 and 17 of FIG. 2, where these windings are then coupled to two parallel-connected 96 inch type VHO fluorescent tubes 130 and 131. A transformer 132, containing windings 16 and 17, is also provided with three filament heater windings 133, 134 and 135. Winding 133 is connected to both filament 136 of tube 130 and filament 137 of tube 131. Winding 134 is connected to filament 138 of tube 131 while winding 135 is connected to filament 139 of tube 130. The two tubes 130 and 131 are connected in parallel with one another by virtue of the connection of filaments 138 and 139 to terminal C of current balancing transformer 140, while the other end of the tubes containing filaments 136 and 137, respectively, are connected to one another as by the wire 141. Note, however, that while tubes 130 and 131 are connected in parallel, the current through the tubes flowing, for example, from the top of winding 17 to the terminal C will flow in physically opposite directions through the tubes which are physically mounted as illustrated in FIG. 3, thereby decreasing radio frequency interference from the tubes.

A-C terminals 110 and 111 are further connected to a relatively small transformer 150 which produces a relatively low voltage which, in combination with the diode 151, provides a 24 volt d-c voltage supply. The output voltage is then applied through resistor 152 to an emitter controlled multivibrator circuit containing transistors 153 and 154 which can, for example, be type 2N4125 transistors.

The multivibrator circuit generally includes conventional components which will cause the circuit to operate at a frequency of about 20 kilocycles. Thus, the resistors 153' to 162 may conventionally have the values in the table following the description of this figure, and similarly capacitors 163 and 164 will have the tabulated values. The output of the multivibrator circuit containing transistors 153 and 154 will be a square wave which is connected to transistor 170 which may be of the type MJE341, where the transistor 170 will be driven with a nonsymmetrical square wave such that the transistor is on for only about one-fourth of the time.

The emitter-collector circuit of transistor 170 drives the transformer 171 which is a two-winding transformer having a secondary winding 172 isolated from the primary winding 173. A resistor 174 is connected in parallel with primary winding 173. The transformer 171 serves to provide current gain since it has a step-down ratio from winding 173 to winding 172 and further provides d-c isolation at the output terminals A and B which are the same terminals A and B which provide the base drive for transistors 116 and 117. Thus, the primary winding 172 is connected to terminals A and B, with resistor 175 in the connection to terminal B.

The combination of transistor 170 and transformer 171 serve as the amplifier driver 14 of FIG. 2, while the multivibrator component transistors 153 and 154 serve as the oscillator 13 of FIG. 2.

The servo amplifier 30 of FIG. 2 is shown in FIG. 3 and contains, in part, the transistor 180 which acts as a variable impedance which is controlled by the setting of the potentiometer 181. It will be noted that the fluorescent tube current from the center tap terminal C of balancing transformer 140 is connected to the collector electrode of transistor 180. The emitter of transistor 180 is connected to ground, so that the peak voltage across the emitter-collector circuit of transistor 180 is a measure of the current through the fluorescent tubes 130 and 131, and thereby the light output of these tubes.

The control potentiometer 181 is connected in series with fixed resistors 182 and 183 which are connected across the capacitor 184. Transistor 180 may be a type MPSUO1 unit. A resistor 185 is connected across its collector base electrodes. The emitter-collector circuit of transistor 180 is then connected to transistor 186 which is a type 2N4123 transistor connected in shunt with the oscillator containing transistors 153 and 154.

The coupling circuit between transistor 180 and 186 includes diodes 187 and 188 which may be type 1N34, and resistors 189 and 190 and capacitors 191 and 192.

A capacitor 193 is connected across the emitter-collector circuit of transistor 186. Since transistor 186 is in shunt with the oscillator, increased current in the collector-emitter circuit of transistor 186 will decrease the voltage available to the oscillator, thus decreasing the magnitude of the oscillation and thereby the drive of transistor 170. This results in less drive to pulse modulator transistors 116 and 117 and thus to the fluorescent tubes 130 and 131 so that less current is applied to transistor 180, resulting in less peak voltage on transistor 180 to be rectified, producing less voltage to turn on transistor 186. Thus, a servo loop is produced which limits the peak voltage on transistor 180 if excessive transistor voltage is called for to stabilize the fluorescent tube current in tubes 130 and 131.

As pointed out above, the current in transistor 180 required to produce a set voltage may be varied by the setting of potentiometer 181 which drives transistor 180. Thus, the fluorescent tube current can be stabilized at any value from full output to below 1% of the full output.

This dimming effect can be accomplished electronically as by using an electronically variable impedance in place of the potentiometer 181 which is mechanically adjusted. For example, an electronic control system can be applied to rapidly and continuously vary the base input to transistor 180 to cause a flashing of the fluorescent tubes 130 and 131, for example, at 10 flashes per second by varying the set voltage between a bright output and a dimmed output.

It is desirable that circuit means be provided to protect transistors 116 and 117 against abnormally high voltages, such as those which appear the first few seconds after the circuit is turned on and before the filaments are heated and the tubes begin to conduct normal current. If full drive is applied to transistors 116 and 117 during this time as would be caused by the above described servo loop, very high pulses will occur across transistors 116 and 117 during starting. The transistor circuit including transistor 195 (which may be a type 2N4125) is provided to prevent this situation.

The peak voltage on transistors 116 and 117 is measured across the diode 196 and is attenuated and is applied to the transistor 195 by the circuit including resistors 197 and 198, 199, capacitor 200 and zener diode 201. The emitter of transistor 195 is connected to terminal D through resistor 202. The emitter of transistor 195 is further connected to ground through resistor 203 and to the collector of transistor 186 through resistor 204.

In operation, the peak voltage which is applied to transistors 116 and 117 is attenuated and applied to the base of transistor 195. If this voltage is sufficient to turn on transistor 195, transistor 186 will turn on, which causes less drive to transistors 116 and 117, thus reducing the voltage swing produced on transistors 116 and 117. Bias voltage is then placed on the emitter of transistor 195 so that it does not start to turn on until the peak voltage on transistors 116 and 117 is very nearly as high as allowable. Thus, the high voltage protection circuit 34 of FIG. 2 is produced in the circuit which includes transistor 195 in FIG. 3. Stated in other words, the voltage limiting circuit operates by reducing the base drive to transistors 116 and 117, reducing the back swing of the choke 17, the back swing being added to the supply voltage to generate the striking potential for the tubes 130 and 131.

The circuit of FIG. 3 performed satisfactorily using the following tabulated components. It will be apparent that other circuit values and modifications could be used, and that integrated circuit components could be advantageously used to save space.

TABLE OF COMPONENTS

| Resistors | |
|---|---|
| 118,119 | .56r, 5 watt |
| 120 | 22r |
| 121 | 56r, 2 watt |
| 152 | 560r |
| 153 | 120r |
| 154 | 2200r |
| 155 | 27K |
| 156 | 27K |
| 157 | 3300 |
| 158 | 4700 |
| 159 | 4700 |
| 160 | 470 |
| 161 | 270 |
| 162 | 270 |
| 174 | 6800r |
| 175 | 6.8r, 1 watt |
| 181 | 25K |
| 182 | 2700r |
| 183 | 220 |

TABLE OF COMPONENTS-continued

| Resistors | |
|---|---|
| 185 | 1K |
| 189 | 3900r |
| 190 | 680r |
| 197 | 47K, 2 watts |
| 198 | 2200 |
| 199 | 1K |
| 202 | 47K, 1 watt |
| 203 | 3300r |
| 204 | 680r |
| Capacitors | |
| 115 | 1200Mf |
| 122 | .002Mf, 1Kv |
| 163 | 5Mf |
| 164 | .012Mf |
| 184 | 500Mf, 50V |
| 191 | .039Mf |
| 192 | .022Mf |
| 193 | .22Mf |
| 200 | .05Mf, 600V |

Although there has been described a preferred embodiment of this invention, many variations and modifications will now be apparent to those skilled in the art. Therefore, this invention is to be limited, not by the specific disclosure herein, but only by the appended claims.

The embodiments of the invention in which an exclusive privilege or property is claimed are defined as follows:

1. An energizing circuit for a gas discharge lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; said source of electric power including an a-c source and a d-c converter connected to said a-c source; said oscillator circuit means and said transistor and lamp being driven from the d-c output of said d-c converter.

2. The energizing circuit of claim 1 which further includes a coupling transformer having first and second winding portions; said first and second winding portions being connected in closed series relation with one another and with said gas discharge lamp; said first winding portion being connected in a closed series relation with said source of electric power and said emitter and collector electrodes of said transistor and in parallel with the series connection of said second winding portion and said gas discharge lamp.

3. An energizing circuit for a gas discharge lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; a coupling transformer having first and second winding portions; said first and second winding portions being connected in closed series relation with one another and with said gas discharge lamp; said first winding portion being connected in closed series relation with said source of electric power and said emitter and collector electrodes of said transistor and in parallel with the series connection of said second winding portion and said gas discharge lamp.

4. An energizing circuit for a gas discharge lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; a dimming control circuit means for controlling the output light of said lamp; said dimming control means comprising control means connected to said oscillator circuit means for varying the magnitude of said pulse current, whereby the output light of said lamp varies directly with said pulse current magnitude into the base of said transistor even though said transistor is always in saturation.

5. The energizing circuit of claim 4 wherein said transistor is always driven to saturation by said pulse current in said base of said transistor at the least magnitude of said pulse current within the range of dimming adjustment.

6. The energizing circuit of claim 5 wherein said gas discharge lamp is a very high output fluorescent lamp.

7. The energizing circuit of claim 4 wherein said pulse current has a pulse repetition frequency of from about 10 kilohertz to about 100 kilohertz.

8. The energizing circuit of claim 4 which further includes a coupling transformer having first and second winding portions; said first and second winding portions being connected in closed series relation with one another and with said gas discharge lamp; said first winding portion being connected in a closed series relation with said source of electric power and said emitter and collector electrodes of said transistor and in parallel with the series connection of said second winding portion and said gas discharge lamp.

9. The energizing circuit of claim 4 which further includes servo amplifier means connected in series with said gas discharge lamp and monitoring the current flow through said lamp; said servo amplifier means including output control circuit means connected to oscillator circuit means for varying the magnitude of said output current pulse into the base of said transistor, whereby a given current flow will be maintained in said lamp.

10. The energizing circuit of claim 9 wherein said dimming control circuit means is connected to said servo amplifier means and varies the adjustment magnitude of said given current, thereby to affect control of the light output of said lamp.

11. The energizing circuit of claim 10 wherein said dimming control circuit means includes an oscillating circuit for varying the light output of said lamp at a given frequency.

12. The energizing circuit of claim 9 wherein said transistor is always driven to saturation by said pulse current in said base of said transistor at the least magnitude of said pulse current within the range of dimming adjustment.

13. The energizing circuit of claim 10 which further includes overvoltage protection circuit means for preventing excessive voltage across the emitter-collector electrodes of said transistor by adjusting said pulse current magnitude to reduce tube current in response to excessive voltage on said transistor.

14. An energizing circuit for a gas discharge lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; a servo amplifier means connected in series with said gas discharge lamp and monitoring the current flow through said lamp; said servo amplifier means including output control circuit means connected to said oscillator circuit means for varying the magnitude of said output current pulse into the base of said transistor, whereby a given current flow will be maintained in said lamp.

15. An energizing circuit for a gas discharge lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; a second gas discharge lamp connected in parallel with said lamp and current balancing transformer means for connecting one end of each of said lamps together; the other ends of said lamps being directly connected to one another; and tap means on said current balancing transformer to define an output terminal for said parallel-connected lamps.

16. The energizing circuit of claim 15 wherein said parallel-connected lamps are disposed physically parallel to one another and are closely spaced to one another; the parallel currents in each of said lamps flowing in opposite directions.

17. An energizing circuit for a gas discharge lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; said pulse current having a length less than about 30 microseconds, whereby said gas discharge lamp, which would normally have a negative resistance characteristic, operates as though it has a less negative resistance characteristic.

18. An energizing circuit for a gas discharge lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; and an inductive impedance connected in series with said gas discharge lamp.

19. The circuit of claim 18 which further includes coupling transformer means having a winding connected across said gas discharge lamp.

20. An energizing circuit for a gas discharging lamp; said energizing circuit including a source of electric power, oscillator circuit means for producing a pulse current at a relatively high frequency, and a pulse modulator circuit which includes a transistor having base, collector and emitter electrodes; said source of electric power, said emitter and collector electrodes of said transistor and said gas discharge lamp being connected in series; said oscillator circuit means being connected to said transistor to inject said pulse current into said base of said transistor; said pulse current having a minimum magnitude sufficiently high to drive said transistor into saturation; and coupling transformer means having a winding connected across said gas discharge lamp.

21. An energizing circuit for a gas discharge lamp; said energizing circuit including a source of electric power, oscillator circuit means for producing a pulse current at a relatively high frequency, and a pulse modulator circuit which includes an electronic switching means having control terminal means, power output terminal means and power input terminal means; said source of electric power, said power output and power input terminal means of said electronic switching means and said gas discharge lamp being connected in series; said oscillator circuit means being connected to said electronic switching means to inject said pulse current into said control terminal means of said electronic switching means; said pulse current having a minimum magnitude sufficiently high to render said electronic switching means fully conductive; and overvoltage protection circuit means for preventing excessive voltage across said power input and power output terminal means of said electronic switching means by adjusting said pulse current magnitude to reduce tube current in response to excessive voltage across said power input and power output terminal means.

22. The energizing circuit of claim 21 wherein said overvoltage protection circuit means includes first transistor circuit means having input and output terminals; said output terminals of said first transistor circuit means connected to said control terminal means; and second transistor circuit means having input and output terminals; said input terminals of said second transistor circuit means connected to said power output and input terminals; said output terminals of said second transistor circuit means connected to said input terminals of said first transistor circuit means whereby, when the voltage across said power input and output terminals exceeds a given value, the output signal at said output terminals of said second transistor circuit means changes in a direction to change the output of said output terminals of said first transistor circuit means to reduce the drive of said control terminal means.

23. The energizing circuit of claim 22 which further includes a diode means and capacitor means connected in said input terminals of said second transistor circuit means.

24. An energizing circuit for a gas discharge lamp; said energizing circuit including a source of electric power, oscillator circuit means for producing a pulse current at a relatively high frequency, and a pulse modulator circuit which includes an electronic switching means having control terminal means, power output terminal means and power input terminal means; said source of electric power, said power output and power input terminal means of said electronic switching means and said gas discharge lamp being connected in series; said oscillator circuit means being connected to said electronic switching means to inject said pulse current into said control terminal means of said electronic switching means; said pulse current having a minimum magnitude sufficiently high to render said electronic switching means fully conductive; a second gas discharge lamp connected in predetermined circuit relation with said lamp and being simultaneously energized therewith; and current balancing means connected to said gas discharge lamps to ensure a predetermined division of electrical power between said gas discharge lamps.

25. An energizing circuit for a gas discharge lamp; said energizing circuit including a source of d-c power, a pulse modulator for producing a high frequency pulse current output from said source of d-c power, and a coupling transformer means for coupling said pulse current output from said pulse modulator into said gas discharge lamp; said pulse current output having a pulse length sufficiently short that said gas discharge lamp which would normally have a negative resistance characteristic operates with a resistance characteristic which is less negative than said negative resistance characteristic, and wherein said coupling transformer means includes first and second winding portions; said first and second winding portions being connected in closed series relation with one another and with said gas discharge lamp; said first winding portion being connected in a closed series relation with said source of d-c power and said pulse modulator and in parallel with the series connection of said second winding portion and said gas discharge lamp.

26. An energizing circuit for a gas discharge lamp; said energizing circuit including a source of d-c power, a pulse modulator for producing a high frequency pulse current output from said source of d-c power, and a coupling transformer means for coupling said pulse current output from said pulse modulator into said gas discharge lamp; said pulse current output having a pulse length sufficiently short that said gas discharge lamp which would normally have a negative resistance characteristic operates with a resistance characteristic which is less negative than said negative resistance characteristic, and wherein a second gas discharge lamp is connected in parallel with said lamp and current balancing transformer means for connecting one end of each of said lamps together; the other ends of said lamps being directly connected to one another; and tap means on said balancing transformer to define an output terminal for said parallel-connected lamps.

27. The energizing circuit of claim 26 wherein said parallel-connected lamps are disposed physically parallel to one another and are closely spaced to one another; the parallel currents in each of said lamps flowing in opposite directions.

28. An energizing circuit for a gas discharge lamp; said energizing circuit including a source of d-c power, a pulse modulator for producing a high frequency pulse current output from said source of d-c power, and a coupling transformer means for coupling said pulse current output from said pulse modulator into said gas discharge lamp; said pulse current output haaving a pulse length sufficiently short that said gas discharge lamp which would normally have a negative resistance characteristic operates with a resistance characteristic which is less negative than said negative resistance characteristic, and servo amplifier means connected in series with said gas discharge lamp and monitoring the current flow through said lamp; said servo amplifier means including output control circuit means connected to said pulse modulator to maintain the magnitude of said current pulse to said lamp at a given adjustable value.

29. The energizing circuit of claim 28 which further includes dimmer circuit means connected to said servo amplifier means for varying the adjustment value of said pulse current magnitude.

30. An energizing circuit for a gas discharge lamp; said energizing circuit including a source of d-c power, a pulse modulator for producing a high frequency pulse current output from said source of d-c power, and a coupling transformer means for coupling said pulse current output from said pulse modulator into said gas discharge lamp; said pulse current output having a pulse length sufficiently short that said gas discharge lamp which would normally have a negative resistance characteristic operates with a resistance characteristic which is less negative than said negative resistance characteristic; dimming circuit means connected to said pulse modulator for adjustably controlling the magnitude of said pulse current output to maintain a given adjustment value; said pulse modulator including a power transistor having emitter and collector electrodes connected in series with said lamp; and a pulse current source connected to the base of said transistor for driving said transistor into saturation at a repetition rate of from about 10 kilohertz to about 100 kilohertz and for said short pulse length; said dimming circuit means including means for varying the magnitude of the pulse current injected into said base; said transistor always being driven into saturation over substantially the full range of dimming of said lamp.

31. The energizing circuit of claim 30 wherein said pulse length is less than about 30 microseconds.

* * * * *